US012578135B2

(12) United States Patent
Russo et al.

(10) Patent No.: US 12,578,135 B2
(45) Date of Patent: Mar. 17, 2026

(54) METHOD FOR OPERATING A HOUSEHOLD REFRIGERATOR HAVING SPECIFIC OPERATING PROCESS COORDINATION IN DEPENDENCE UPON A QUIET TIME INTERVAL, AND HOUSEHOLD REFRIGERATOR

(71) Applicant: BSH Hausgeräte GmbH, Munich (DE)

(72) Inventors: Marcel Russo, Hermaringen (DE); Mathias Sigl, Herbrechtingen (DE); Hans Schwaiger, Babenhausen (DE)

(73) Assignee: BSH Hausgeräte GmbH, Munich (DE)

( * ) Notice: Subject to any disclaimer, the term of this patent is extended or adjusted under 35 U.S.C. 154(b) by 110 days.

(21) Appl. No.: 18/599,344

(22) Filed: Mar. 8, 2024

(65) Prior Publication Data

US 2024/0318884 A1 Sep. 26, 2024

(30) Foreign Application Priority Data

Mar. 21, 2023 (DE) ..... 10 2023 202 481.0

(51) Int. Cl.
*F25C 1/00* (2006.01)
*F25D 21/00* (2006.01)

(52) U.S. Cl.
CPC ..... *F25C 1/00* (2013.01); *F25D 21/002* (2013.01); *F25C 2400/10* (2013.01); *F25C 2600/02* (2013.01); *F25C 2600/04* (2013.01)

(58) Field of Classification Search
CPC .... F25B 2500/12; F25C 1/00; F25C 2400/10; F25C 2600/02; F25C 2600/04; F25D 21/002
See application file for complete search history.

(56) References Cited

U.S. PATENT DOCUMENTS

2010/0114378 A1 5/2010 Son et al.

FOREIGN PATENT DOCUMENTS

DE 102011121226 A1 3/2013
JP H1130468 A 2/1999
JP 2003322451 A 11/2003

*Primary Examiner* — Jonathan Bradford
(74) *Attorney, Agent, or Firm* — Laurence A. Greenberg; Werner H. Stemer; Ralph E. Locher

(57) ABSTRACT

A method operates a household refrigerator that has an ice maker that produces and/or dispenses ice in an ice production mode. The household refrigerator can at least partially deactivate a sub-process of the ice production mode in dependence upon a user-defined deactivation criterion. A first operating process is provided which when executed generates a first noise emission that is lower than that of the sub-process. A user-specific quiet time interval of the ice maker is provided as a deactivation criterion. At least the at least one sub-process of the ice production mode is deactivated at least partially during the quiet time interval. The operation of the household refrigerator is coordinated such that the first operating process is executed at least temporarily during the quiet time interval.

15 Claims, 2 Drawing Sheets

METHOD FOR OPERATING A HOUSEHOLD REFRIGERATOR HAVING SPECIFIC OPERATING PROCESS COORDINATION IN DEPENDENCE UPON A QUIET TIME INTERVAL, AND HOUSEHOLD REFRIGERATOR

CROSS-REFERENCE TO RELATED APPLICATION

This application claims the priority, under 35 U.S.C. § 119, of German Patent Application DE 10 2023 202 481.0, filed Mar. 21, 2023; the prior application is herewith incorporated by reference in its entirety.

FIELD AND BACKGROUND OF THE INVENTION

One aspect of the invention relates to a method for operating a household refrigerator that has an ice maker. A further aspect of the invention relates to a household refrigerator.

Household refrigerators that have an ice maker are known. Ice makers usually have an ice tray in which liquid, in particular water, is introduced, which is then frozen in this ice tray to form shaped elements of ice, such as ice cubes. Usually, an ice maker also has a storage container that is separate from the ice tray. In this storage container, the shaped elements of ice are temporarily stored in the ice maker in a frozen state when they are removed from the ice tray. Such a removal of the shaped elements of ice from the ice tray into the storage container can in particular also be performed automatically. The shaped elements of ice can thereby be produced in an automated manner, and, since the storage container usually has a larger volume than the ice tray, a larger number of shaped elements of ice can be produced in several cycles, all of which can then be temporarily stored in the storage container. Only when a user requests dispensing of shaped elements of ice that are temporarily stored in the storage container are they removed from the storage container and ejected via a dispensing unit of the household refrigerator. Due to the automatic process, sufficient shaped elements of ice are always in stock in the storage container.

During operation of the ice maker, noises, which are perceived from the outside, can occur during specific production steps of ice production. However, such noises can be disruptive for a user of the household refrigerator. This can be disruptive, in particular, when, for example, conversations of a user are being held in the area of the installation location of the household refrigerator, for example when a telephone call or a video conference or another personal conversation with another person is being held. This can also be disruptive if the user would like to receive for example other acoustic information, for example, would like to listen to music and/or would like to watch television. Last but not least, such a noise can also have a disruptive effect on a user or a person if there is a general need for quiet.

SUMMARY OF THE INVENTION

It is the object of the present invention to provide a method and a household refrigerator with which the operation of an ice maker is improved with regard to the emission of noise.

This object is achieved by a method and a household refrigerator in accordance with the independent claims.

One aspect of the invention relates to a method for operating a household refrigerator that has an ice maker. The ice maker is configured to produce and/or dispense ice in an ice production mode. In particular, the method contains the following steps:

- providing the household refrigerator with the possibility of at least partially deactivating at least one sub-process of the ice production mode in dependence upon a user-defined deactivation criterion;
- providing at least one first operating process of the household refrigerator, which when executed generates a first noise emission that is lower than that of the sub-process;
- specifying a user-specific quiet time interval of the ice maker, in particular one that at least reduces the noise emission to the outside in comparison with a basic operation of the household refrigerator, as a deactivation criterion, wherein at least one sub-process of the ice production mode is deactivated at least temporarily during the quiet time interval; and coordinating the operation of the household refrigerator in such a manner that the first operating process is executed at least temporarily during the quiet time interval.

With the method, it is now possible to control and configure the ice production more individually, in particular with regard to the production itself and/or the dispensing. It is particularly advantageous in this context that, in principle, a household refrigerator is configured in such a manner that it even has the possibility of deactivating this ice production mode in a user-specific defined manner. This is to be understood in particular to mean that this deactivation of the ice production mode is made possible irrespective of the other mode of operation of the household refrigerator when it is operated in the switched-on state. Thus, with regard to deactivating the ice production mode, such a possibility is not to be understood as meaning that the entire household refrigerator is switched off, and in particular is then without a power supply, but the possibility mentioned in this regard is only to be understood in the sense that the household refrigerator is still switched on and, very specifically, the ice production mode can be deactivated in a user-defined manner. Such a possibility alone creates a high degree of flexibility in order to be able to operate the ice production mode not only automatically and without the possibility of alteration by a specified control program, but also to be able to take user-specific interests and situations into account.

In the operating processes of the household refrigerator, in which a noise emission is generated, this is to be understood in particular to the effect that the noise emission occurs to the outside and can therefore also be perceived by a person in the environment of the household refrigerator. It is particularly advantageous in the method that a person or a user can now individually specify at least one time phase, namely this quiet time interval. This therefore represents a user-defined deactivation criterion, which in particular can also be processed by a control unit of the household refrigerator. In particular, with such a specification, in particular input of at least one such quiet time interval, the control unit can then automatically deactivate the ice production mode. In particular, this deactivation is automatically controlled by the control unit of the household refrigerator.

It is also particularly advantageous in the method that not only this user-specific specification of the quiet time interval and the associated deactivation of the at least one sub-process of the ice production mode is provided, but that, in addition, an operating process management is also performed intelligently by the household refrigerator itself.

This user-specific specified quiet time phase or this quiet time interval is then namely intelligently used in order to arrange operating processes of the household refrigerator in such a manner that this quiet time interval is also used to execute operating processes, but an at least reduced noise emission of the household refrigerator into the environment occurs compared to an operation of the household refrigerator in which no such quiet time interval is specified. In one exemplary embodiment, this also thereby prevents any operating processes from being executed at all in the quiet time interval, in particular none that also produce a certain, albeit low, noise emission to the outside, but instead in an intelligent manner also prevents the quiet time interval from being used to execute operating processes, but which have a significantly lower noise emission and therefore a significantly lower or no noise interference potential for a person in the surrounding area of the household refrigerator.

The entire mode of operation of the household refrigerator is thereby made possible in a particularly intelligent and efficient manner, and the particularly individually specified at least one quiet time interval can be reacted to intelligently by the household refrigerator itself, in order, for example, not to have to accept any undesired delay of operating processes and/or an at least partial failure of an operating process.

In one exemplary embodiment, during the coordination the quieter first operating process is executed at least temporarily during the quiet time interval. In comparison to an operation of the household refrigerator in which in the time phase in which the quiet time interval is specified and desired, at least in some situations an operation of the household refrigerator with reduced noise is thereby rendered possible. In particular, if a louder operating process would otherwise be executed in the time phase in which the quiet time interval is present.

In one exemplary embodiment, during the coordination a check is performed as to which sequence, which is specified as a basic setting, and/or at which time intervals, which are specified as a basic setting, the first operating process and/or the at least one sub-process are executed in or are provided for execution in a basic operation of the household refrigerator in which a quiet time interval is not specified. This is another particularly advantageous exemplary embodiment, since it is basically thereby checked at what time of day and/or for how long the quiet time interval is provided and then a check is performed as to which of the operating processes are provided at this time of day and/or over this time duration in this base setting or in this basic operation of the household refrigerator. This is because, for example, if it is the case in an individual specification that a particularly quiet operating process, in particular the quieter first operating process, would be executed anyway during this user-specific specified quiet time interval, a rearrangement of the operating processes that would be executed with the coordination is not necessary in one exemplary embodiment. On the other hand, however, if it is the case that a louder operating process, in particular also a second operating process, would be executed at least in phases during this at least one intended quiet time interval and thus in the individually specified time duration and/or the time of day, in accordance with the specified basic operation of the household refrigerator, this second operating process is then prevented during the quiet time interval in this context. Exactly in such a case, it is then intelligently provided that the sequence and/or the time intervals of this basic setting of the operating processes are changed. For example, it can be provided in this context that the operating processes are exchanged in the sequence and/or the time duration or the time intervals of at least one operating process is changed, for example extended or shortened. A highly dynamic operating process management is thereby provided. In particular, these operating processes can thus be varied dynamically, in particular in dependence upon at least the one user-specific specified quiet time interval.

In one exemplary embodiment, in dependence upon the information of the basic operation and the quiet time interval, a check is performed as to whether the sequence and/or the time intervals are changed such that the execution of at least the louder operating process is prevented in the quiet time interval. A noise interference potential for a person, in particular the person who has specified the quiet time interval, is thereby reduced in the best possible way.

In one exemplary embodiment, after the end of the quiet time interval a sequence that may have been changed during coordination and/or a time duration of at least one operating process that may have been changed during coordination is changed back to the sequence that is specified in a basic operation and/or to the time duration that is specified in a basic operation of the operating processes. In particular, this is also performed automatically. In particular, this is performed by the control unit of the household refrigerator. In an advantageous exemplary embodiment, a quasi-fully automatic coordination operation of the operating processes is therefore also performed by the control unit. It can thereby also be avoided that after the end of a quiet time interval the actual basic setting of the household refrigerator is not confused in relation to the operating processes. In one exemplary embodiment, a defrosting of the evaporator of a freezer compartment of the household refrigerator is executed as a first operating process. Such a defrosting process is basically a relatively quiet operating process, in particular in comparison with other operating processes of the household refrigerator. An evaporator of this type is part of a cooling circuit of the household refrigerator. In particular, the household refrigerator can have at least one freezer compartment and/or at least one refrigerator compartment. Especially in the evaporator, which is intended for cooling the freezer compartment, ice can accumulate in the course of the operating time due to the thermodynamic processes, which is known to reduce the efficiency. In a clever way, it is now possible for exactly one such defrosting process to be executed at least temporarily during the user-specific specified quiet time interval in the event of the case. A particularly low-noise operating process is thereby executed during the quiet time interval. The noise interference potential is thereby minimized and, on the other hand, a great benefit is achieved in that the evaporator is again in the defrosted state or in a more defrosted state.

In a further exemplary embodiment, a defrosting of the ice maker can be executed in addition to or instead of the first operating process. This means in particular that an evaporator of the ice maker is defrosted. This is particularly advantageous in the case of exemplary embodiments of an ice maker, which have their own evaporator, by means of which an ice tray of the ice maker is cooled. Such exemplary embodiments of ice makers, which have their own internal evaporator, can freeze the water that is present in the ice tray independently of other compartments and modes of operation of the household refrigerator. For this purpose, it is provided that such an evaporator that is associated with the ice maker is arranged directly below the ice tray and/or directly to the side of the ice tray. A particularly high cooling effect on the ice tray can thereby take place and water that is introduced therein can be frozen particularly quickly and efficiently. However, since this evaporator can also accumulate ice in the course of the serviceable life, it is also of particular advantage here to defrost it again and again. It is thereby also particularly advantageous if this ice production mode is deactivated in the quiet time interval, and the ice maker-side evaporator is defrosted. This is because the ice maker-side evaporator is then in an at least more ice-free state when the ice production mode is reactivated, so that ice production can take place more efficiently in many respects.

In a further exemplary embodiment, a further sub-process of the ice production mode can be executed in addition to or instead of the first operating process. For example, such a further sub-process can be the freezing of water in the ice tray of the ice maker.

In one exemplary embodiment, as a sub-process of the ice production mode water is supplied to the ice maker. In one exemplary embodiment, for example, it is possible for the supply of water to lead to an undesirably loud splashing noise to the outside, which may be perceived as disruptive on a user-specific basis.

In a further exemplary embodiment, as a sub-process of the ice production mode a rearrangement of shaped elements of ice that are produced can be performed internally in the ice maker. This is in particular a procedure in which shaped elements of ice that are produced in the ice tray are introduced into a storage container of the ice maker. This process is to be regarded as a particularly noisy sub-process in comparison with other operating processes of the ice maker of the household refrigerator, which involves a significantly higher noise emission to the outside in comparison with other operating processes. This is because the shaped elements of ice that are removed from the ice tray then fall into the storage container of the ice maker, so that corresponding noises are generated as a result.

This removal of the shaped elements of ice from the ice tray into the storage container, which is usually performed automatically by the ice maker, is therefore not predictable for a person in the environment of the household refrigerator. Therefore, it may be particularly desired on a user-specific basis that such a second operating process is avoided or definitively excluded in the quiet time interval. Therefore, a person is not disturbed by such an unpredictable second operating process in the quiet time interval that is desired by them.

In one exemplary embodiment, the household refrigerator can have at least one second operating process. In one exemplary embodiment, this second operating process can have a noise emission that is higher than the first operating process. It is possible that this second operating process is coordinated by the control unit in such a manner that it is not executed during a quiet time interval, in particular is therefore deactivated. The second operating process can be a process that is different from the sub-process of the ice production mode.

In one exemplary embodiment, in the quiet time interval a temperature value is set in a freezer compartment of the household refrigerator and the temperature value is lower than a desired temperature value in a basic operation of the household refrigerator in which a quiet time interval is not set. This is another particularly advantageous exemplary embodiment, since such a cooling of the freezer compartment to a value below the desired temperature value produces a kind of cold buffer in the freezer compartment. This quiet time interval is therefore used to cool the freezer compartment further than would be required in accordance with the desired temperature value. This results in a temperature value buffer for a subsequent operation of the freezer compartment, so that in the further operation of the household refrigerator, the freezer compartment can be cooled at least partially with an energy expenditure that is lower than for maintaining the desired temperature value. The energy management operation of the household refrigerator can thereby also be dynamized and made more flexible in a particularly advantageous manner. The energy that then may not be required in further operation for cooling the freezer compartment can then be made available for other operating processes of the household refrigerator.

In one exemplary embodiment, the temperature value is set at least 2° C. lower than the desired temperature value. If, for example, a desired temperature value in a freezer compartment is minus 18° C., the freezer compartment can be set to a temperature value of, for example, minus 20° C. or lower in the quiet time interval. It is therefore also possible for the temperature value in the freezer compartment to be set to minus 21° C. or minus 22° C., etc., for example, during the quiet time interval. This means that the size of this temperature buffer in the freezer compartment can also be varied particularly individually.

In one exemplary embodiment, after the end of a quiet time interval an ice production mode having a turbo production stage that is different in comparison to an operating production stage is started, and in the turbo production stage the production rate is increased in comparison with the basic production stage. The ice production mode can be started or activated immediately after the end of the quiet time interval. However, it is also possible for there to be a waiting time interval between the end of the quiet time interval and the beginning of the ice production mode. This can take several seconds or even several minutes. It is also possible for this waiting period to last an hour or longer.

The advantageous exemplary embodiment explained above then makes it possible for the loss of ice production, which may have occurred as a result of the deactivation of the ice production mode in the quiet time interval, to be at least partially compensated for by the turbo production stage. The turbo production stage can be automatically set or activated in a manner controlled by a control unit. However, it is also possible for the turbo production stage to be started on a user-specific basis. In this manner, the ice production mode can also be performed in a particularly demand-oriented and energy-efficient manner after the quiet time interval.

In one exemplary embodiment, the time duration of the turbo production stage is determined in dependence upon the time duration of the quiet time interval and/or in dependence upon the time duration since the quiet time interval has ended and/or in dependence upon the actual temperature value in the freezer compartment of the household refrigerator at the end of the quiet time interval and/or in dependence upon at least one actual temperature value in the freezer compartment of the household refrigerator while the turbo production stage is performed. As a result, the turbo production stage can be determined in a highly dynamic and flexible manner. In this manner, a particularly coordinated behavior between energy consumption and desired ice production can also be achieved. If, for example, it is not necessary or not desired for as much ice to be produced as quickly and/or as much as possible after the quiet time interval, the turbo production stage can be completely omitted or, for example, performed for a reduced time duration. This can be the case, for example, when the storage container of the ice maker is filled with ice with a specific threshold filling. In other words, if the storage container contains a quantity of shaped elements of ice that is predictably sufficient for a future dispensing procedure or for future multiple dispensing procedures, the turbo production stage is not required. However, if, for example, a filling quantity has fallen below a threshold value in the storage container, the turbo production stage can be started immediately after the quiet time interval with the activation of the ice production mode.

In one exemplary embodiment, the turbo production stage is performed at most until a prevailing actual temperature value of the household refrigerator has reached the desired temperature value in the freezer compartment. In this exemplary embodiment in particular, the coupling to the aforementioned advantageous exemplary embodiment, in which a cold buffer is built up in the freezer compartment during the quiet time interval, is advantageous. This is because, by way of the freezer compartment being significantly further cooled down to below the desired temperature value during the quiet time interval, especially in conjunction with the turbo production stage, the freezer compartment can be operated using less energy for cooling, as a result of which the temperature in the freezer compartment rises. The energy that is released by the low cooling can be used for the turbo production stage. However, since in one exemplary embodiment the temperature value in the freezer compartment is not intended to be higher than the desired temperature value, this energy, which is used for cooling the freezer compartment for the turbo production stage, is only provided to the turbo production stage until the desired temperature value in the freezer compartment is reached. This also prevents the freezer compartment from becoming undesirably too warm and then in turn requiring a high energy requirement in order to cool the freezer compartment down from a higher temperature to the desired temperature value.

In one exemplary embodiment, it is provided that, when a quiet time interval is specified, the state of the ice maker is checked. In one exemplary embodiment, it is thus possible to check whether, for example, at a beginning of the quiet time interval, the ice shaping tray is filled with shaped elements of ice that have already frozen. If this is the case, the frozen shaped elements of ice can be removed from the ice tray immediately prior to the beginning of the quiet time interval, in particular in a manner automatically controlled by the control unit. In this manner, the ice shaping tray is emptied immediately prior to the quiet time interval. In this way, after the quiet time interval, when an ice production mode is then activated again, the freezing of water in the ice shaping tray can be started immediately. This also enables highly efficient ice production management. The shaped elements of ice are not held in the ice tray for an unnecessary amount of time.

This process is also particularly advantageous if, during the quiet time interval, a defrosting of an ice maker-side evaporator can be executed or is to be executed if necessary as a second operating process. In particular, it is then avoided that shaped elements of ice that are present in the ice tray would not undesirably be partially melted again. In this manner, the ice maker-side evaporator can also be defrosted in a highly efficient manner during the quiet time interval, without the possibility of undesired impairment of shaped elements of ice in the ice tray.

This then also makes it possible for a defrosting process to be executed for longer and/or more intensively without the possibility of undesired impairment of the shaped elements of ice in the ice tray.

In one exemplary embodiment, the ice maker can be a melt-down ice maker. In such an exemplary embodiment, the shaped elements of ice in the ice tray are slightly melted by heating the ice maker, so that they can be easily removed from the ice tray and introduced into the storage container. It is also possible for finished shaped elements of ice to be removed from the ice tray at least temporarily at the beginning of the quiet time interval. This also means that, if such a process of removing shaped elements of ice from the ice tray is not yet completed at the time at which the quiet time interval begins, in one exemplary embodiment this process of removing elements from the ice tray and introducing them into the storage container of the ice maker is still terminated. It is also possible for such a process of removing any finished shaped elements of ice, which may be present in the ice tray, to be started at the beginning of the quiet time interval. In such an exemplary embodiment, a small time interval at the beginning of the quiet time interval is still used in order, if any finished and frozen shaped elements of ice may be present in the ice tray, to remove them from the ice tray and introduce them into the storage container.

A further aspect of the invention relates to a household refrigerator having an ice maker. The household refrigerator furthermore has at least one control unit. The household refrigerator is configured to implement a method in accordance with the above-mentioned aspect or an advantageous exemplary embodiment. The household refrigerator has at least one receiving space for food. This can be a freezer compartment or a refrigerator compartment. In particular, the household refrigerator has at least one freezer compartment and at least one refrigerator compartment. The ice maker of the household refrigerator has, in particular, an ice tray in which water can be introduced, which can be frozen to form shaped elements of ice. In one exemplary embodiment, in addition to the ice tray, the ice maker has a storage container that is separate from the ice tray. The storage container is intended to receive the shaped elements of ice that are dispensed from the ice tray and to store them in a frozen state in the ice maker. In one exemplary embodiment, the ice maker can have its own evaporator. This is arranged directly adjacent to the ice tray. If the ice maker is a melt-down ice maker, in one exemplary embodiment it has a heating system. This heating system is arranged and designed in such a manner that the ice tray can be heated in order to simplify the removal of the frozen shaped elements of ice that are produced from the ice tray. The slight heating results in a slight melting of the shaped elements of ice in the ice tray, so that they detach from the ice tray and can be easily removed. However, it is also possible, in one exemplary embodiment, for the ice maker not to be a melt-down ice maker. In such an exemplary embodiment, the ice tray can be rotated about its longitudinal axis, wherein a corresponding rotation apparatus is provided for this purpose. As a result of such a rotation, the shaped elements of ice that are produced are also detached from the ice tray and can then be easily removed from the ice tray.

A further aspect of the invention relates to a method for operating a household refrigerator that has an ice maker. The ice maker is configured to produce and/or dispense ice in an ice production mode. In particular, the method comprises the following steps:

- providing the household refrigerator with the possibility of deactivating the ice production mode in dependence upon a user-defined deactivation criterion;
- providing at least one first operating process of the household refrigerator, which when executed generates a first noise emission;

providing at least one second operating process of the household refrigerator, which when executed generates a second noise emission that is louder than the first noise emission;

specifying a user-specific quiet time interval of the ice maker as a deactivation criterion, wherein the ice production mode is deactivated during the quiet time interval; and coordinating the at least second operating process in such a manner that the execution of at least the louder second operating process is prevented, in particular at least temporarily, in the quiet time interval.

The advantages already mentioned above also apply here. Advantageous embodiments of the above-mentioned aspect are to be regarded as advantageous embodiments of the further aspect.

A second operating process can be an operating process of the ice maker itself. It can be the above-mentioned sub-process of the ice production mode. However, it can also be another sub-process of the ice production mode. Likewise, it is possible for a second operating process to be an operating process of the household refrigerator that is independent of the ice maker.

The information "top", "bottom", "front", "rear", "horizontal", "vertical", "depth direction", "width direction", "height direction" indicates the positions and orientations given during intended use and intended arrangement of the appliance.

Further features of the invention are evident in the claims, the figures and the description of the figures. The features and feature combinations that are mentioned above in the description and also the features and feature combinations that are mentioned below in the description of the figures and/or that are illustrated in the figures alone are not only usable in the respectively disclosed combination but rather can also be used in other combinations or alone without departing the scope of the invention. There are consequently embodiments of the invention that are to be regarded as included and disclosed, which are not explicitly illustrated and explained in the figures, however are disclosed and can be produced by separate feature combinations in the explained embodiments. There are also embodiments and feature combinations that are to be regarded as disclosed, which consequently do not have all the features of an originally worded independent claim.

Other features which are considered as characteristic for the invention are set forth in the appended claims.

Although the invention is illustrated and described herein as embodied in a method for operating a household refrigerator having specific operating process coordination in dependence upon a quiet time interval, and a household refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
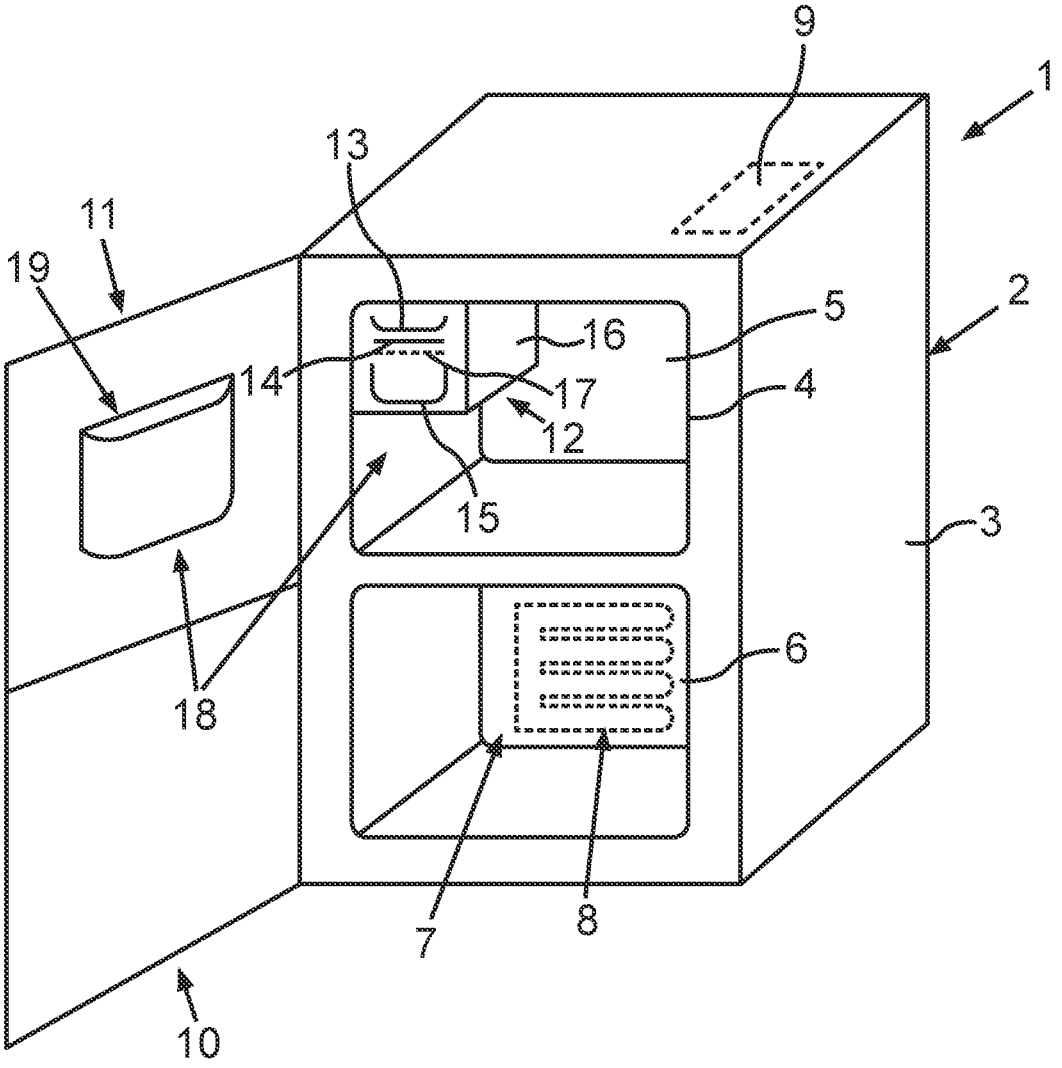
FIG. 1 is a diagrammatic, perspective view of an exemplary embodiment of a household refrigerator in accordance with the invention.

In the figures, identical or functionally identical elements are provided with the same reference characters.

Referring now to the figures of the drawings in detail and first, particularly to FIG. 1 thereof, there is shown an exemplary embodiment of a household refrigerator 1 is illustrated schematically. The household refrigerator 1 is configured for storing and preserving food. The household refrigerator 1 can be a refrigerator or a freezer or a fridge-freezer combination appliance. The household refrigerator 1 has a housing 2. The housing 2 has an outer housing 3. In addition, the housing 2 has an inner container 4 that is separate from the outer housing 3. The inner container 4 delimits with its walls a receiving space 5 for food of the household refrigerator 1. The receiving space 5 can be, for example, a refrigerator compartment. In one exemplary embodiment, the household refrigerator 1 has a further receiving space 6 for food. In the exemplary embodiment, this is in particular a freezer compartment.

In particular, the household refrigerator 1 has at least one refrigeration circuit 7, which is shown only schematically. In one exemplary embodiment, this refrigeration circuit 7 has an evaporator 8 for cooling the freezer compartment 6. The household refrigerator 1 furthermore has a control unit 9. At least some operating processes of the household refrigerator 1, in particular all operating processes of the household refrigerator 1, are controlled using the control unit 9. The household refrigerator 1 furthermore has a door 10. This door is arranged movably on the housing 2. The door is provided in particular for closing the receiving space 6. In one exemplary embodiment, the household refrigerator 1 has a further door 11. This is separate and independent from the door 10. The further door 11 is provided for closing the receiving space 5. The household refrigerator 1 in addition has an ice maker 12. The position and configuration of the ice maker 12 is to be understood merely by way of example and schematically. The ice maker 12 can also be configured or arranged in another way. The ice maker 12 has an ice production mode. With this ice production mode, ice can be produced and/or dispensed. In one exemplary embodiment, the ice maker 12 has an ice tray 13. This is intended to receive water. The ice maker 12 is configured to freeze the water that is introduced into the ice tray 13, so that shaped elements of ice, such as ice cubes, are produced for this purpose. In one exemplary embodiment, the ice maker 12 has its own evaporator 14. This is provided and arranged to cool the ice tray 13, so that the water that is introduced therein freezes to form shaped ice elements. The ice maker-side evaporator 14 is arranged at least partially directly adjacent to the ice tray 13 and/or at least in some areas in direct abutment with the ice tray 13. In addition, in one exemplary embodiment, the ice maker 12 has a storage container 15. The frozen shaped elements of ice that are dispensed from the ice tray 13 are introduced into this storage container 15 and temporarily stored in the ice maker 12. The mentioned components can be arranged in a housing 16 of the ice maker 12.

It is also possible in one exemplary embodiment for the ice maker 12 to have a heating system 17. This can be provided for heating the evaporator 14 in order to defrost it, for example. If the ice maker 12 is configured as a melt-down ice maker, it can have a further heating system, by means of which the ice tray 13 can be slightly heated in order to slightly melt the frozen shaped elements of ice that are produced, in order to be able to easily remove them from the ice tray 13 and throw them into the storage container 15.

In one exemplary embodiment, the ice maker 12 is a component of an ice production and dispensing apparatus 18 of the household refrigerator 1. This ice production and dispensing apparatus 18 has a dispensing unit 19. This dispensing unit is arranged in particular on the door 11. In one exemplary embodiment, it can thus be provided that shaped elements of ice that are temporarily stored in the storage container 15 are dispensed to the dispensing unit 19, for example by means of a conveyor screw. On the outside of the door 11, which is remote from the receiving space 5, an ejection unit can be formed, from which the shaped elements of ice are introduced into a container that may be provided, such as a glass or the like, in particular when the door 11 is closed.

Figure 2:
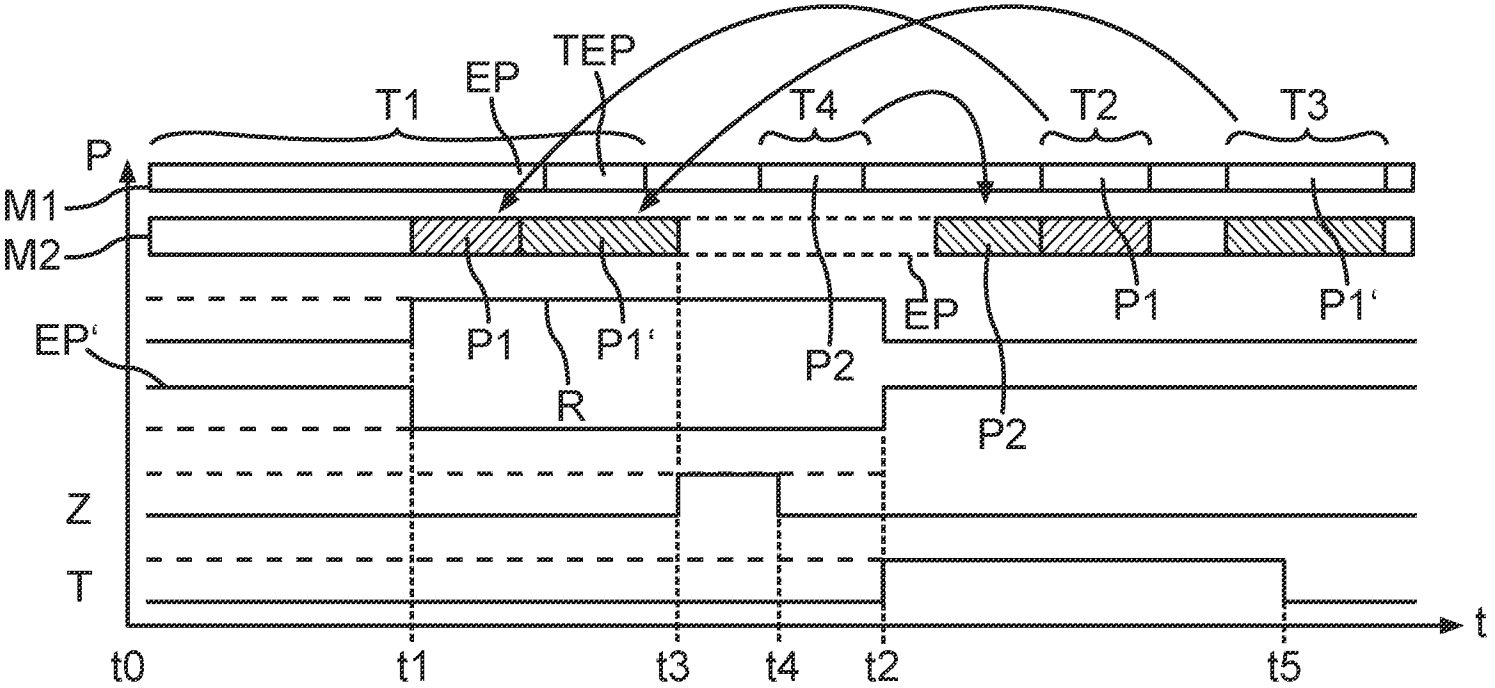
FIG. 2 is a simplified diagram illustrating a temporal sequence of an exemplary embodiment of a method for operating the household refrigerator.

The household refrigerator 1 is configured to implement a method, which is explained below with reference to an exemplary embodiment. In particular, this method is implemented using the household refrigerator 1. For this purpose, FIG. 2 shows a simplified diagram in which the time t is plotted on the horizontal axis and various operating processes P of the household refrigerator 1 are illustrated on the vertical axis.

In principle, the household refrigerator 1 is provided or configured with the possibility of deactivating an ice production mode of the ice maker 12 in dependence upon a user-defined deactivation criterion, which is defined in a user-specific manner. In the case of the household refrigerator 1, the individual possibility is therefore basically created that a user can deactivate the ice production mode in dependence upon this deactivation criterion by specifying their own deactivation criterion. If such a deactivation criterion is input, this can be detected by the control unit 9 in one exemplary embodiment, and the deactivation of the ice production mode then associated therewith is then controlled in particular automatically by the control unit 9. As is apparent in FIG. 2, the representation of the operating processes P is illustrated on the vertical axis and a sequence and/or a respective time duration of modes M is illustrated in the uppermost line.

In one exemplary embodiment, the household refrigerator 1 has at least one first operating process, which when executed generates a first noise emission to the outside of the household refrigerator 1. In one exemplary embodiment, the household refrigerator 1 can be provided with at least one second operating process that is different therefrom, which when executed generates a second noise emission to the outside of the household refrigerator 1, which is louder than the first noise emission.

In particular, the household refrigerator 1 has a basic operation M1. In this basic operation M1, a predetermined sequence of operating processes is performed, in particular in each case in a basic setting. In particular, in this basic operation, operating processes are executed in a predetermined sequence and/or over respectively individual specified time intervals. In accordance with the illustration, it is provided in this basic operation M1 that an ice production mode EP is performed during a time interval T1. The ice production mode EP has sub-processes. A first sub-process can be the supply of water to the ice maker 12. A second sub-process can be the freezing of the water in the ice tray 13. A third sub-process can be the removal of the frozen shaped elements of ice from the ice tray 13. A fourth sub-process TEP can be the relocation of these shaped elements of ice from the ice tray 13 into the storage container 15. In particular, the fourth sub-process represents a process. The fourth sub-process is louder in terms of noise emission compared to the others. Thus, for example, the first, second and third sub-process can also be examples for first operating processes.

In addition, a first operating process P1 can be executed in this basic operation M1. This first operating process can be executed, for example, for a time interval T2. It is also possible in the exemplary embodiment for a further first operating process P1' to be executed, in particular, for example, for a time interval T3. The first operating process P1 can be, for example, a defrosting of the preferably present evaporator 14 of the ice maker 12. The further first operating process P1' can be, for example, a defrosting process of the evaporator 8. Both the number and the sequence as well as the respective durations of the operating processes presented for the basic operation M1 are to be understood merely by way of example. In particular, the ice production mode EP, in particular the sub-process in which a relocation of shaped elements of ice in the ice maker 12 itself takes place, can also be an exemplary embodiment of a second operating process, if such a second operating process is present or can be executed. However, other second operating processes P2 of the household refrigerator 1 are also possible in addition to or instead of this. However, the second operating process P2 is louder than the first operating processes P1 and P1' with regard to the noise emission to the outside of the household refrigerator 1.

In one exemplary embodiment, at least one user-specific specified quiet time interval R can be specified, in which the ice production mode EP of the ice maker 12 is deactivated in a manner controlled by the control unit 9, in particular at least temporarily. In this context, the quiet time interval R is illustrated in an example in FIG. 2. Thus, for example, starting from a starting time t0, at which an entire method scenario is considered, the quiet time interval R can be started at a time t1. A quiet time interval R is therefore desired and specified by the user, which starts at the time t1 and ends in particular at a time t2.

Depending on this quiet time interval R, in one exemplary embodiment, the at least second operating process P2 is coordinated in such a manner that the execution of at least one louder second operating process is prevented in this quiet time interval R, i.e. in the time interval between t1 and t2. In particular, the ice production mode EP is thus deactivated in a manner controlled by the control unit 9 in the exemplary embodiment during the time duration of the quiet time interval R.

In another exemplary embodiment, a user-specific quiet time interval R of the ice maker 12 is specified as a deactivation criterion, wherein at least the one sub-process TEP of the ice production mode EP is deactivated at least partially, in particular completely, during the quiet time interval R. In the exemplary embodiment, the operation of the household refrigerator 1 is coordinated in such a manner that the first operating process P1, P1' is executed at least temporarily during the quiet time interval R.

This results in a changed operation M2 compared to the basic operation M1. In this changed operation, the operating processes are rearranged in comparison to the basic operation M1.

In the illustrated exemplary embodiment, this means that a check is preferably performed as to which sequence, which is specified as a basic setting, and/or at which time intervals, which are specified as a basic setting, the first operating process P1 and/or the further operating process P1', and/or the second operating process P2 and/or the sub-process TEP are executed in or are provided for execution in the basic operation M1 of the household refrigerator 1 in which a quiet time interval R is not specified. In the illustrated exemplary embodiment, this would mean that the ice production process EP, in particular the sub-process TEP, would be executed in the basic operation M1 at least temporarily during the quiet time interval R. Due to this constellation, however, the ice production mode EP, in particular the sub-process TEP, as illustrated by the time profile EP' in the diagram in FIG. 2, is at least prevented. It is provided here that the sub-process TEP of the ice production mode EP is not activated or remains not activated at time t1. If the ice production mode EP is activated at this time t1, as is illustrated in an exemplary manner in FIG. 2, the ice production mode is deactivated at the time t1. In accordance with the temporal representation having the profile EP', this deactivation of at least the sub-process TEP of the ice production mode EP lasts until time t2.

In one exemplary embodiment, it is preferably provided that the first operating processes P1 and P1' presented here by way of example are rearranged during the coordination of the operating processes. This means that during this coordination, the first operating processes P1 and P1', which only take place later in time in the basic operation M1, are brought forward. This is indicated by the arrows. It is provided here that the first operating process P1 and also the further first operating process P1' are coordinated in such a manner that they are executed at least temporarily during the quiet time interval R. In one exemplary embodiment, it is possible for the control unit 9 to check how long the first operating process P1 and/or how long the further first operating process P1' last. In one exemplary embodiment, this can be compared to the duration of the quiet time interval R. Depending on this, a decision can then be made as to which of the first operating processes P1 and/or P1' is executed, and/or in which sequence these first operating processes P1 and P1' may be executed and/or over which respective time duration the first operating processes P1 and P1' are executed. In the present exemplary embodiment, which is by no means to be understood as conclusive, the quiet time interval R is longer than the summed periods of time T2 and T3. It is therefore possible, for example, for both first operating processes P1 and P1' to be brought forward in the operating process coordination and thus to be shifted forward in time and for both to be able to be executed completely within the quiet time interval R. In particular, they can be executed here in the sequence that is specified by the basic operation M1.

In one exemplary embodiment, the execution of the first operating processes P1 and P1' in accordance with the specified basic operation M1, i.e. also later after the quiet time interval R, can thus also be omitted if necessary, in particular at the times at which they would be specified in accordance with the basic operation M1. However, it is also possible, which can also be dependent on the duration of the quiet time interval R and in particular also on the time t1 and/or the time t2, for the operating processes P1 and P1' to also be additionally started and executed after the end of the quiet time interval R at the times respectively provided by the basic operation M1. In such an exemplary embodiment, the first operating processes P1 and P1' are then not removed from the basic operation M1 without replacement or shifted forward in time and then no longer executed at the time provided in accordance with the basic operation M1, but they can then also be executed in this exemplary embodiment at least temporarily during the quiet time interval R. The execution of the operating processes P1 and P1' that are specified by the basic operation M1 at the respectively specified times in the basic operation M1 can then also take place in addition.

In particular, at least one first operating process P1 and P1' is executed here at least temporarily during the quiet time interval R due to the coordination.

In one exemplary embodiment, in dependence upon the information of the basic operation M1 and the quiet time interval R, a check is performed, in particular by the control unit 9, as to whether the sequence and/or the time intervals of the operating processes, in particular of the first operating processes P1 and P1', are changed such that the execution of at least one louder second operating process, in this case at least the ice production process EP, is prevented in the quiet time interval R.

In one exemplary embodiment, it is also possible after the end of the quiet time interval R, i.e. at time t2 or after time t2, for a changed sequence of the operating processes or a changed time duration of at least one operating process to be changed if necessary back to the sequence specified in the basic operation M1 and/or the time duration of the operating processes.

As is also apparent from the illustration in FIG. 2 in accordance with an exemplary embodiment, a temperature value that is lower than a desired temperature value in the basic operation M1 of the household refrigerator 1, in which a quiet time interval R is not set, is set in the freezer compartment, which is formed by the receiving space 6, during the quiet time interval R. This temperature value can be set at least 2° C. lower than the desired temperature value. For this purpose, in the exemplary embodiment in accordance with FIG. 2, an additional cooling operation Z is started, for example, at a time t3. If, for example, the target temperature value in the freezer compartment is reached before time t2, for example already at a time t4, this additional cooling operation Z is terminated again at time t4. In particular, however, it is provided that this target temperature value, which is set at least 2° C. lower than the desired temperature value, is maintained at least until time t2, at which the quiet time interval R ends. If necessary, it can be provided that the additional cooling operation Z remains activated until time t2.

Due to this additional cooling operation Z, a temperature value that is lower than the desired temperature value is therefore present in the freezer compartment at the end of the quiet time interval R at time t2.

It is possible in one exemplary embodiment for an ice production mode EP to be reactivated after the end of the quiet time interval R. This can be the case immediately at time t2, at which the quiet time interval R ends. However, it is also possible for the activation of the ice production mode EP to be shifted to a later time t2. In the exemplary embodiment that is illustrated in FIG. 2, the ice production mode EP is reactivated in accordance with the time profile EP' at the time t2. In one exemplary embodiment, it can be provided that the ice production mode EP is not started and performed with a basic production stage, but with a different turbo production stage T. At the turbo production stage, the production rate of ice is increased compared to the basic production stage. Due to this turbo production stage T, as is also symbolized in the diagram in FIG. 2, this ice production rate is then increased, for example, until a time t5 compared to the basic production stage. This is particularly advantageous in that the energy requirement is increased in the time interval in which the turbo production stage T is performed, i.e. here between the time t2 and t5. It can be provided that the cooling of this receiving space 6 is reduced during the turbo production stage T by the cold buffer (temperature value lower than the desired temperature value) that has been built up in the receiving space 6 during the quiet time interval R, so that a temperature increase from the set lower temperature value to the higher desired temperature value takes place in the receiving space 6. In particular, the turbo production stage T is performed at most until a prevailing actual temperature value in the receiving space 6, i.e. the freezer compartment, has reached the desired temperature value. In the exemplary embodiment, this can be at time t5.

The following is a summary list of reference numerals and the corresponding structure used in the above description of the invention.

LIST OF REFERENCE CHARACTERS

1 Household refrigerator
2 Housing
3 Outer housing
4 Inner container
5 Receiving space
6 Freezer compartment
7 Refrigeration circuit
8 Evaporator
9 Control unit
10 Door
11 Door
12 Ice maker
13 Ice tray
14 Evaporator
15 Storage container
16 Housing
17 Heating
18 Ice production and dispensing apparatus
19 Dispensing unit

The invention claimed is:

1. A method for operating a household refrigerator having an ice maker producing and/or dispensing ice in an ice production mode, which comprises the following steps of:

providing the household refrigerator with an ability to at least partially deactivate at least one sub-process of the ice production mode in dependence upon a user-defined deactivation criterion;

providing at least one first operating process of the household refrigerator, which when executed generates a first noise emission that is lower than that of the at least one sub-process;

specifying a user-specific quiet time interval of the ice maker as the user-defined deactivation criterion, wherein at least the at least one sub-process of the ice production mode is deactivated at least partially during the user-specific quiet time interval; and coordinating an operation of the household refrigerator such that the at least one first operating process is executed at least temporarily during the user-specific quiet time interval, wherein during the coordinating step, a check is performed as to which sequence, which is specified as a basic setting, and/or at which time intervals, which are specified as the basic setting, the at least one first operating process and/or the at least one sub-process are executed in or are provided for execution in a basic operation of the household refrigerator in which the user-specific quiet time interval is not specified.

2. The method according to claim 1, which further comprises completely deactivating the at least one sub-process during the user-specific quiet time interval.

3. The method according to claim 1, wherein in dependence upon information of the basic operation and the user-specific quiet time interval, the check is performed as to whether the sequence and/or the time intervals are changed such that an execution of at least one sub-process, which is a louder subprocess than at least one other subprocess, is prevented in the user-specific quiet time interval.

4. The method according to claim 1, wherein after an end of the user-specific quiet time interval the sequence that may have been changed during coordination and/or a changed time duration of at least one the at least one first operating process and the at least one sub-process is changed back to the sequence that is specified in the basic operation and/or to the time duration of at least one of the at least one first operating process and the at least one sub-process.

5. The method according to claim 1, which further comprises:

executing a defrosting of an evaporator of a freezer compartment of the household refrigerator as the at least one first operating process; and/or executing a defrosting of the ice maker as the at least one first operating process.

6. The method according to claim 1, wherein as the at least one sub-process water is supplied to the ice maker and/or a rearrangement internally in the ice maker of shaped elements of ice that are produced is performed.

7. The method according to claim 1, wherein immediately prior to a beginning of the user-specific quiet time interval and/or immediately with the beginning of the user-specific quiet time interval shaped elements of ice from an ice tray of the ice maker are introduced into a storage container of the ice maker.

8. The method according to claim 5, wherein the executing of the defrosting of the ice maker includes defrosting an ice maker-side evaporator as the at least one first operating process.

9. A household refrigerator, comprising:

an ice maker; and a controller; wherein the household refrigerator is configured to implement the method according to claim 1.

10. The household refrigerator according to claim 9, wherein said ice maker has an ice tray and an evaporator that is disposed directly adjacent to said ice tray of said maker and said evaporator is provided so as to directly cool said ice tray.

11. A method for operating a household refrigerator having an ice maker producing and/or dispensing ice in an ice production mode, which comprises the following steps of:

providing the household refrigerator with an ability to at least partially deactivate at least one sub-process of the ice production mode in dependence upon a user-defined deactivation criterion;

providing at least one first operating process of the household refrigerator, which when executed generates a first noise emission that is lower than that of the at least one sub-process;

specifying a user-specific quiet time interval of the ice maker as the user-defined deactivation criterion, wherein at least the at least one sub-process of the ice production mode is deactivated at least partially during the user-specific quiet time interval, wherein in the user-specific quiet time interval a temperature value is set in a freezer compartment of the household refrigerator and the temperature value is lower than a desired temperature value in the basic operation of the household refrigerator in which the user-specific quiet time interval is not set; and coordinating an operation of the household refrigerator such that the at least one first operating process is executed at least temporarily during the user-specific quiet time interval.

12. The method according to claim 11, which further comprises setting the temperature value at least 2° C. lower than the desired temperature value.

13. A method for operating a household refrigerator having an ice maker producing and/or dispensing ice in an ice production mode, which comprises the following steps of:

providing the household refrigerator with an ability to at least partially deactivate at least one sub-process of the ice production mode in dependence upon a user-defined deactivation criterion;

providing at least one first operating process of the household refrigerator, which when executed generates a first noise emission that is lower than that of the at least one sub-process;

specifying a user-specific quiet time interval of the ice maker as the user-defined deactivation criterion, wherein at least the at least one sub-process of the ice production mode is deactivated at least partially during the user-specific quiet time interval; and coordinating an operation of the household refrigerator such that the at least one first operating process is executed at least temporarily during the user-specific quiet time interval, wherein after an end of the user-specific quiet time interval, the ice production mode has a turbo production stage that is different in comparison with a basic production stage is started, and in the turbo production stage a production rate of the ice is increased in comparison with the basic production stage.

14. The method according to claim 13, wherein a time duration of the turbo production stage is determined:

in dependence upon a time duration of the user-specific quiet time interval; and/or in dependence upon a time duration since the user-specific quite time interval has ended; and/or in dependence upon an actual temperature value in a freezer compartment of the household refrigerator at an end of the user-specific quiet time interval; and/or in dependence upon at least one actual temperature value in the freezer compartment of the household refrigerator while the turbo production stage is performed.

15. The method according to claim 13, wherein the turbo production stage is performed at most until a prevailing actual temperature value in a freezer compartment of the household refrigerator has reached a desired temperature value in the freezer compartment.

* * * * *